United States Patent [19]

Scurlock

[11] 3,991,583

[45] Nov. 16, 1976

[54] METHOD OF PROVIDING AN UNDERWATER ENCLOSURE

[76] Inventor: John T. Scurlock, 6209 Schouest, Metairie, La. 70003

[22] Filed: Sept. 16, 1974

[21] Appl. No.: 506,606

Related U.S. Application Data

[60] Division of Ser. No. 349,709, April 10, 1973, Pat. No. 3,837,171, which is a continuation of Ser. No. 112,861, Feb. 5, 1971, abandoned, which is a continuation-in-part of Ser. No. 843,543, July 22, 1969, abandoned.

[52] U.S. Cl. ..... 61/69 R; 52/2

[51] Int. Cl.[2] ..... B63C 11/36; E04B 1/343

[58] Field of Search..... 61/69 R, 72.3; 52/2; 135/1 R

[56] References Cited

UNITED STATES PATENTS

| | | | |
|---|---|---|---|
| 2,923,305 | 2/1960 | Cline | 52/2 X |
| 3,386,254 | 6/1968 | Connally | 61/69 R |
| 3,452,764 | 7/1969 | Bell | 135/1 R |
| 3,475,915 | 11/1969 | Caplan | 61/69 R |

*Primary Examiner*—J. Karl Bell

*Attorney, Agent, or Firm*—Pugh & Keaty

[57] ABSTRACT

An inflatable underwater structure for providing an artificial environment around a work area, for example, at the sub-sea base of an off-shore oil platform, permitting such work as welding and the like; the structure is made up of one integral sheet of material for a custom job or a series of selected sheets fastened together about the structural support members; the material includes zippered sections so that the material can be placed about and around the structural members; in order to insure a substantially air-tight system, neck sealing means are included about the structural members at their intersection with the sheet material as well as air-tight means within the zippered sections; although the system could be used on land, it is particularly applicable to sub-sea situations.

10 Claims, 29 Drawing Figures

METHOD OF PROVIDING AN UNDERWATER ENCLOSURE

REFERENCE TO RELATED APPLICATION

This application is a division of prior co-pending application Ser. No. 349,709 entitled "Inflatable Underwater Structure" and filed on Apr. 10, 1973, being issued as U.S. Pat. No. 3,837,171 Sept. 24, 1974, which in turn is a continuation of application Ser. No. 112,861, entitled "Inflatable Underwater Structure" and filed Feb. 5, 1971, now abandoned which in turn is a continuation-in-part of my copending U.S. application Ser. No. 843,543, entitled "Air Wrap Product" and filed July 22, 1969 now abandoned.

BACKGROUND OF THE INVENTION

This invention relates in general to the method of providing an inflatable underwater structure about one or more steel structural members which can be used to create a sub-sea artificial environment around a work area to easily and safely permit such work activities as inspection, welding, x-raying and painting.

A very serious problem which has been facing the off-shore oil industry is the great difficulties involved in properly maintaining and repairing the sub-sea steel structural support members in off-shore platforms and in the various submarine pipeline systems. A particularly acute problem has been in trying to weld in a sub-sea environment.

In attempting to overcome these problems the prior art has tried to use steel diving and welding chambers in order to create an artificial environment or atmosphere for sub-sea work. However, such chambers are inordinantly expensive and clumsy to use. Moreover, when the work has to be done in an area where there are several steel structural members radiating out at different angles, the diving chambers could not be used or else, if used, often caused more damage to the associated production tubes or risers or to the secondary structural members than originally existed on the member to be repaired.

Alternately, welding techniques have been devised for welding directly in the wet environment but these techniques have been unsatisfactory and highly dangerous and usually produced a high percentage of inferior weldments.

The present invention overcomes the problems of the prior art by providing an inflatable underwater structure which can be used regardless of the structural complexity of the work area to create an artificial, gaseous environment such as air around the sub-sea work area. As will be seen more fully below, the inflatable structure is relatively inexpensive, takes no esoteric skills to assemble, other than certain basic training, and allows for the ideal environment within which the work may be performed. Thus, with air in the inflatable structure a worker need not use the relatively clumsy scuba diving equipment while he is at work.

The inflatable structure can be broken down as desired for easy portability and because of its relative inexpensiveness can be stocked at many locations in the field to allow for immediate use.

These and other great advantages and objects of the present invention over the prior art will become apparent in the description and discussion of the details of the preferred embodiments presented below.

BRIEF DESCRIPTION OF THE DRAWINGS

FIG. 2A is a partial, perspective view of the neck interface between the inflated structure and a structural member, while

FIGS. 16 – 23 illustrate various accessories used in association with the inflated structure of the present invention; more particularly:

FIG. 16 is a partial, cross-sectional view of the material of the inflated structure showing the stress points and D-rings;

FIG. 17 is a perspective view of one section of the structure showing the relative locations of the flotation pockets and the snap-on weights;

FIGS. 18A and B are perspective and cross-sectional views, respectively, of two types of sealing members for sealing off fractures within the steel structural members being worked on;

FIG. 20 is a top, cross-sectional view of a channel beam, using "hot dog" tubes to produce a rounded surface;

FIG. 21 is a partial, cross-sectional view showing the "teeth-like" projections on the internal side of a stress clamp used with the present invention;

FIG. 22 is a perspective view on the inside of the inflated structure showing a floating platform accessory in use; and FIG. 23 is a perspective view on the inside of the inflated structure showing the placement of a welding hood accessory.

DETAILED DESCRIPTION OF THE PREFERRED EMBODIMENTS

Figure 1B:
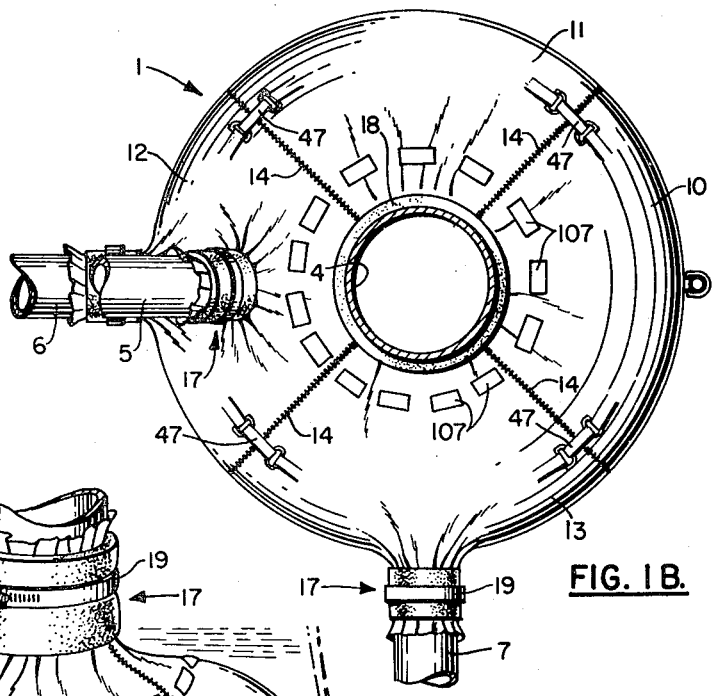
FIG. 1B is a partial top view of the inflated structure.
Figure 1A:
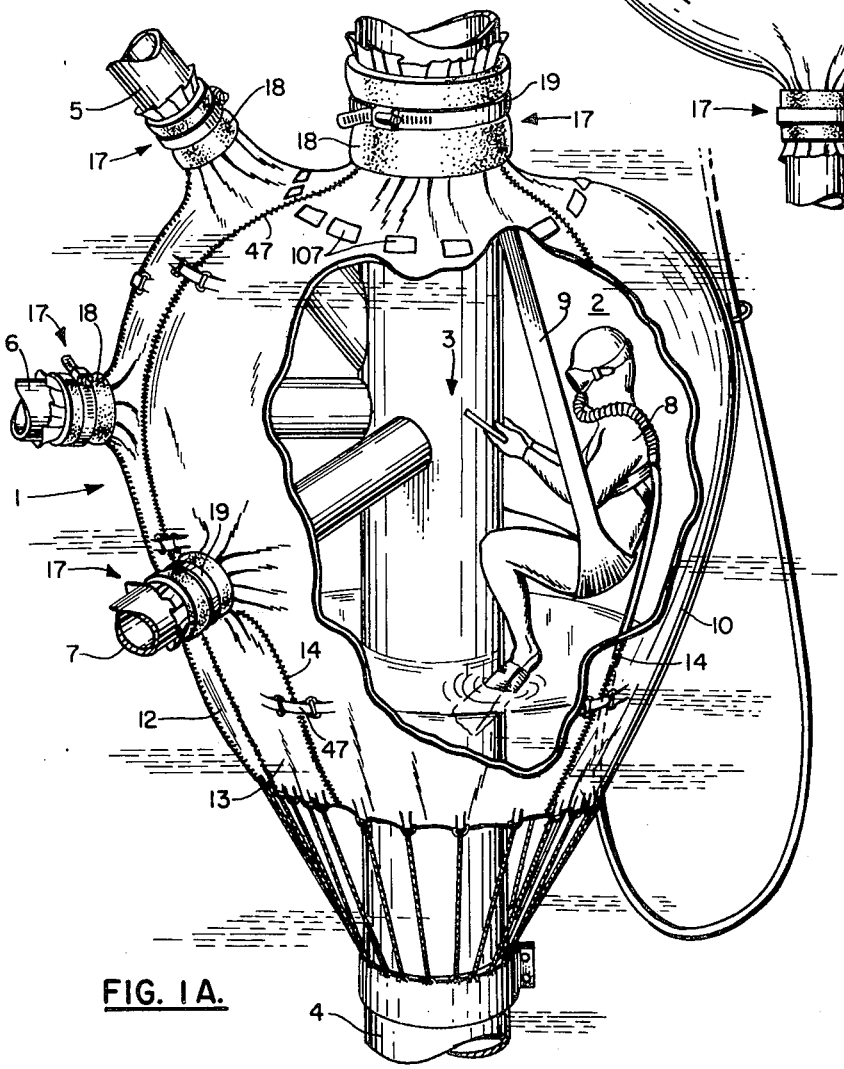
FIG. 1A is a perspective view of the assembled, inflated structure of the present invention, partially cutaway, showing the workman in the interior of the structure.

As illustrated in FIG. 1A, the present invention provides an inflatable structure 1 for creating an artificial environment 2 such as air about a work area 2 at a sub-sea level.

The construction material of the air bag 1 of the present invention is designed in such a way that it is adaptable to whatever complex contours or configurations which the structure members surrounding a work area may present. However, for the purposes of illustration, the specific embodiments herein will be described as applied to a typical support structure of an off-shore platform having a vertical support member and one or more cross-members or braces emanting from the support member. Thus, the inflatable structure 1 is made of flexible film material and is adapted to fitted about and around the structural support member 4 and structural cross-members 5, 6 and 7 which are to be worked upon.

As will be explained more fully below, the structure 1, when inflated provides in effect an open-bottom, multi-section, air filled balloon in which a diver 8 can freely work below the water surface. The diver 8 suspended on, for example, sling 9 can thus inspect, weld, x-ray, paint or do any other desired work in the artificial, controlled atmosphere provided within the substantially air-tight and water-tight inflated structure 1.

In order to permit "universal" application, i. e., application to many different structural configurations, the air bag 1 is made up of a multitude of various sections, each designed for a particular type of application. Thus for the support structure of FIG. 1, the air bag 1 includes four sections 10 – 13, which are interconnected together by means of water-tight zippers 14 along their side peripheries.

Figure 7:
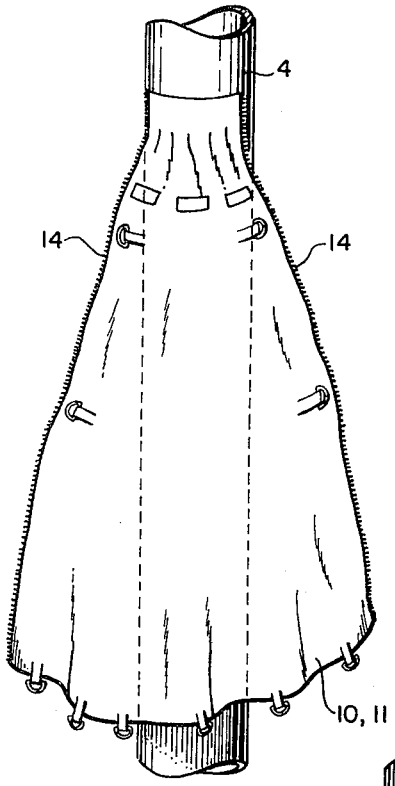
FIGS. 7, 8 and 9 are perspective views of three types of sections of the inflated structure, viz., sections in which there are no structural cross-members, one structural cross-member and two structural cross-members, respectively.
Figure 8:
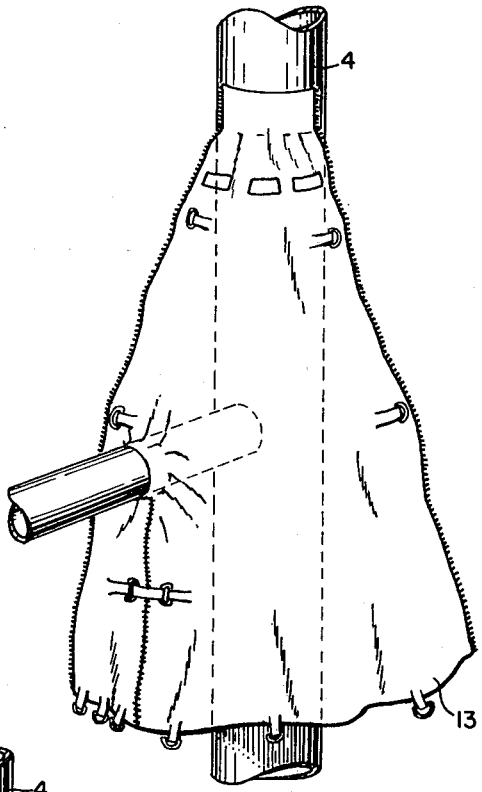
Figure 9:
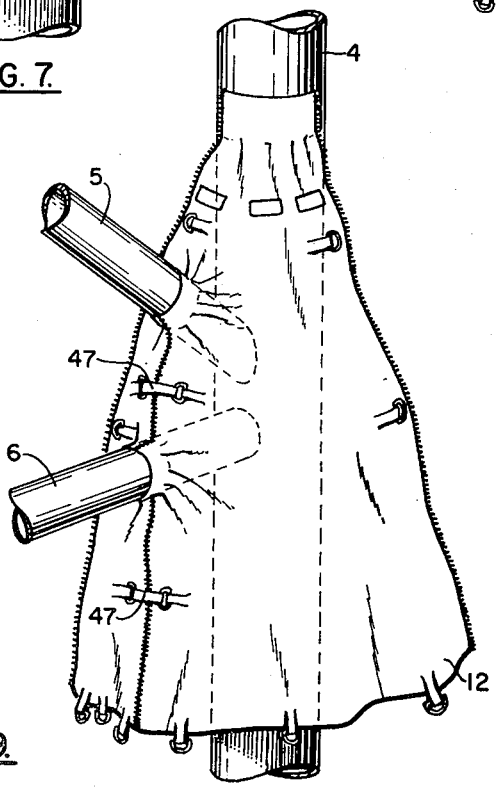

Bag sections 10 and 11 include no opening (note FIG. 7), while section 12 includes two openings for the cross-members or braces 5 and 7 (note FIG. 9). Bag section 13 includes one opening for cross-member or brace 7 (note FIG. 8). Alternately, in place of section 13 one could use a two-opening section like section 12 by tying off and completely closing the unused or unnecessary opening. Additionally other types and forms of sections for other applications can be provided. Each section is typically twenty-five inches across at its upper end and one hundred inches across at its lower end.

Figure 2A:
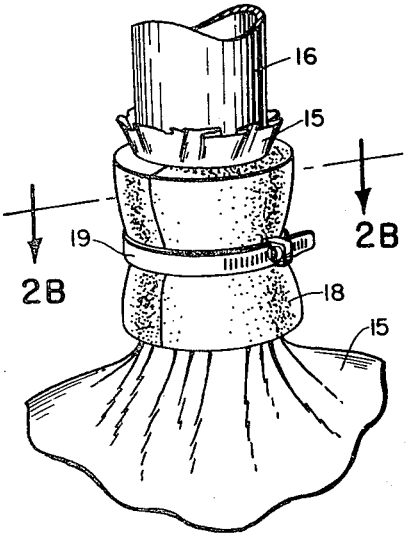
Figure 2B:
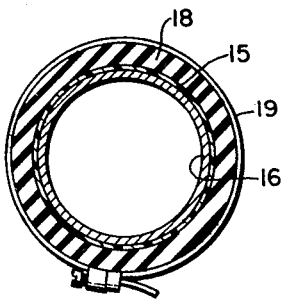
FIGS. 2B and 2C are top and side cross-sectional views, respectively, of the neck interface.
Figure 2C:
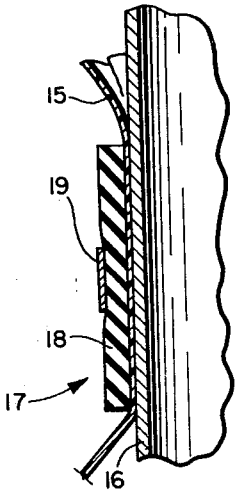

In order to produce a water-tight seal between the bag material 15 and the particular structural member 16 to which it is attached, a neck interfacing portion is provided. As illustrated in FIGS. 2A – C, the neck portion 17 includes a layer of air bag material 15 placed next to the structural member 16 and on top of which is placed a layer of foam material 18. Foam materials for the layer 18 have been found to be a low density closed cell foam or a non-connected cellular foam such as a polyvinylcholride resin based foam. Such foam layers are water-tight. The foam layer 18 can include a pressure sensitive adhesive on its inner surface for easy application and an outer protective liner 18′ of nylon. Alternately, the foam layer 18 may be placed in direct contact with the structural member 16 with the air bag material placed on top of the foam layer.

This compressed interface between the air bag 15 and the structural member 16 results in a substantially air/water-tight structure. A slight air leak out through the interface is possible and indeed desirable because the restricted, controlled leakage allows for regular replenishment or renewal of the air environment. What is to be normally avoided of course is the uncontrolled leakage of the air.

Figure 3:
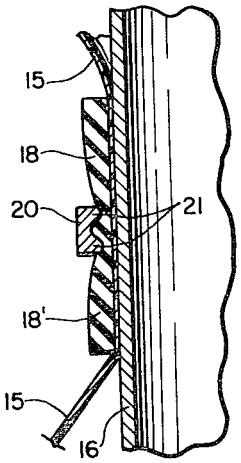
FIG. 3 is a side, cross-sectional view, similar in perspective to FIG. 2C, of a second embodiment of the steel outer band clamp for the neck interface.

Alternately, it has been found that, rather than the standard flat steel band clamp 19, superior sealing results can be obtained by using a ridged-surface outer clamp such as that illustrated in FIG. 3. The alternate, outer clamp 20 is likewise made of a flexible, band material but includes on its bearing surface two or more ridges 21 (two illustrated) running about its length.

To complete the air/water tightness of the inflated structure 1, it is necessary that the zippers 14 likewise possess a substantial degree of air/water tightness. There is available in the market several brands of water-tight zippers and these may be used for the zippers 14. However, because of the relatively delicate nature of these standard, prior art zippers, it is necessary to isolate these zippers from any substantial stress or strain.

Figure 4:
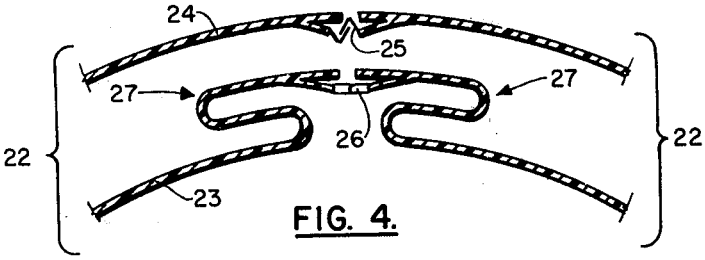
FIG. 4 is a partial, cross-sectional view of the material of the inflated structure showing the zipper details of the material.

This isolation may be accomplished by structure the inflatable material in the manner shown in FIG. 4. To provide this isolation, the inflatable material 22 has an inner lining 23 of air and water impervious film material and an outer layer 24 of strong material such as coated nylon. The outer layer is designed to absorb and withstand all the stresses and strains placed on the inflatable structure and includes a strong, heavy duty structural type zipper 25 which is not necessarily water-tight but can withstand high stress without failure. The inner lining 23 includes a water-tight zipper 26 on which not structural stresses are placed because of the presence of slack sections 27 included in the film material 23. Thus by using two zippers, one for structural strength and the other for water-tightness, a workable solution is achieved.

Figure 5A:
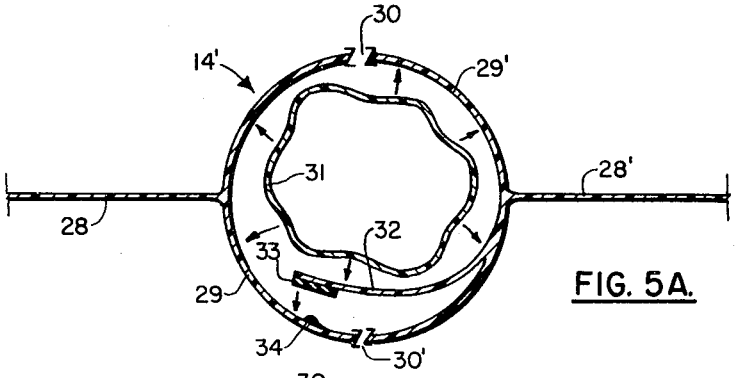
FIGS. 5A and 6B are partial, cross-sectional views, similar in perspective to FIG. 4, showing second and third embodiments, respectively, of the water-tight portions of the zipper elements.
Figure 5B:
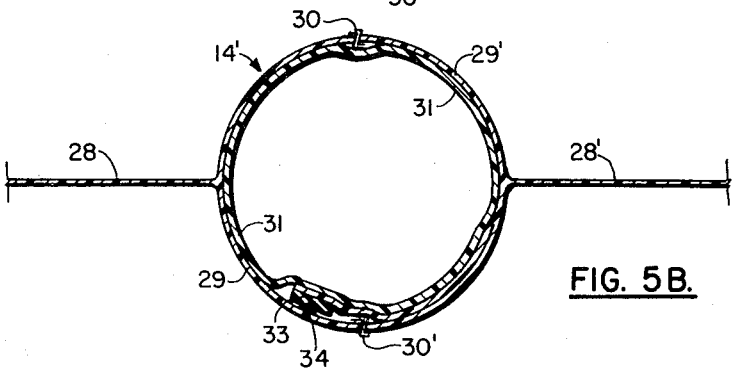
Figure 6:
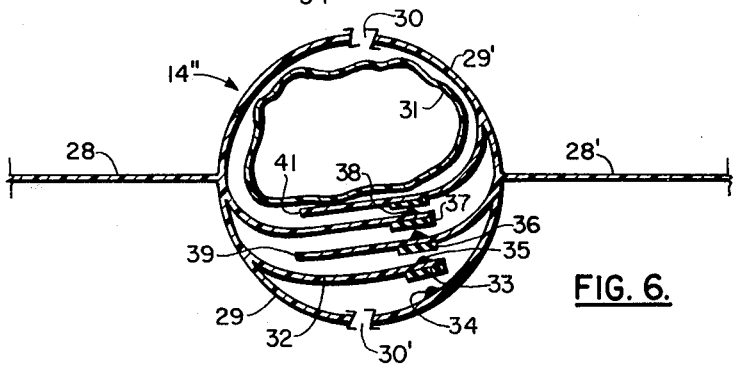

However, in spite of the general isolation of water-tight zipper 26 from stresses, field tests have shown that on occasion undue stress is still placed on the water-tight zipper 26, particularly during the assembly of the bag structure 1 causing it to fail. Hence a totally new zipper structure, avoiding completely the use of delicate water-tight zippers, has been devised and two embodiments of this new sealing structure are illustrated in FIGS. 5 and 6.

The first embodiment 14′ (FIGS. 5A and B) of this new water-tight zippered structure for the material 28/28′ of the inflatable structure includes a two-part housing 29/29′ joined together by two heavy-duty structural type zippers 30/30′. Included within the housing 29/29′, which is made of water impervious material, is an elongated inflatable bag 31 and water-tight sealing means 32 – 34. Sealing means 32 – 34 comprises a layer 32 of water impervious material extending out from the wall 29′ of the housing and having a section 33 of low density closed cellular foam at its other end. On the surface of the housing wall 29 opposite to the foam section 33 is a projecting, longitudinal bead 34. The bag 31, layer 32 with foam section 33, and the bead 34 extend the full length of the outer housing 29/29′.

In order to interconnect the material sections 28/28′ and effect a water-tight seal therebetween, the two zippers 30 30′ are zippered closed and the internal bag 31 inflated. As the bag 31 becomes inflated, it expands out against the layer 32 which in turn is pushed toward and against the bead 34 (note direction arrows in FIG. 5A) until it reaches its fully inflated state (note FIG. 5B).

In order for air or water to leak from one side of fabric material 28/28' to the other side, it must pass through the two zippers 30, 30' via the intersection of the foam section 33 and the longitudinal bead 34, as well as between the mating surfaces of the wall of the bag 31 and the housing wall 29. However, the sealing means 32 – 34 is highly effective and no substantial leakage occurs.

In order to increase the sealing effects of the zippered structure, a second embodiment 14'' (FIG. 6) is illustrated, similar in structure to the first embodiment 14' but having a multiple number of sealing layers. Like numerals are used for the same elements and they all function as described above with respect to FIG. 5. The zippered structure 14'' of FIG. 6 includes a multiple number of layers 32, 39 – 41 of water impervious material alternately extending out from the housing walls 29/29'. Alternately foam sections 33, 36, 38 and longitudinal beads 34, 35, 37 are provided to form a series of water sealing intersections or surfaces as the bag 31 is inflated, these sealing intersections, all of which must be traversed before leakage occurs, completely seal off the zippered structure 14''.

Many variations of these water-tight, zippered structures are possible, the only basic thing required being of course that some water sealing, mechanical means be provided in the path between the two zippers 30, 30'.

Likewise the precise material used for the fabric of the inflatable structure or air bag is somewhat optional as long as it is flexible, easy to handle, light-weight and water impervious.

Figure 10:
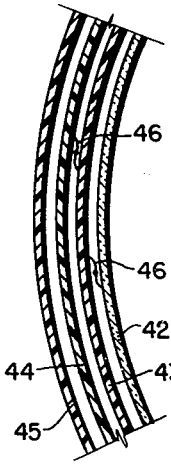
FIG. 10 is a partial, cross-sectional view of the various layers of material used in the inflatable structure of the present invention.

A material that has been found satisfactory has been a composite material made up of the following layers (as generally illustrated in FIG. 10):

a. an inner layer or interliner 42 of abestos coated material for resisting heat and fire;
b. a film layer 43 that is 100% water-tight and is of inflatable quality throughout the entire enclosure;
c. a coated, nylon layer 44 that has the desirable strain capabilities such that it will have sufficient strength under most presurable working conditions; and
d. a second, coated nylon layer 45 for the exterior layer to resist the excessive abrasive conditions which must be faced in use.

The bag material may consist of all of the above or only a partial number of the above layers or a duplication of the layers, depending upon the requirements of a particular job. The layers can be interconnected by flanges 46 (illustrated in their untaut condition) or the like or the layers and sections of the material can be rejoined together by sewing, electronic welding or using adhesives.

The over-all air bag material of course is fabricated in such a manner that the seams or perimeters of the material must have some form of closure (zipper or otherwise) that will have both the requisite strength and air/water-tightness when used to join two pieces of the material together. Appropriate neck interface portions for mating with and allowing for the penetration of cross-members must also of course be provided for.

Moreover, rather than using the "universal" multi-type sections 10 – 13 to make up the inflatable bag, customized bags could be made for each particular job. Thus, if the bag and job site illustrated in FIG. 1 had been approached on a one-time use, customized basis, three of the four full-length zippers 14 could have been eliminated, the bag being made from one continuous sheet Such a customized approach is practical because of the relative inexpensiveness and potentially great availability of the material used in the present invention.

Because of the relative vulnerability of the zippers, particularly the prior art water-tight zippers, it is desirable to have them isolated from as much lateral or surface stress as possible. In order to achieve this, stress belts 47 (note FIGS. 1 and 7 – 9) are included across the zippers pulling the material together and taking up the lateral stress in those areas.

Figure 14:
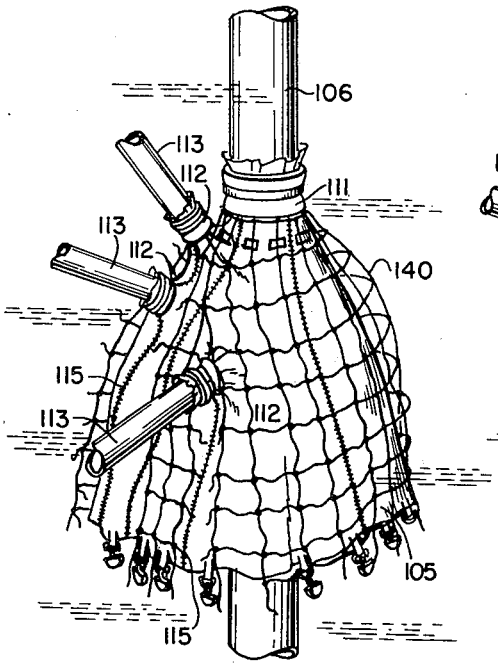
Figure 15:
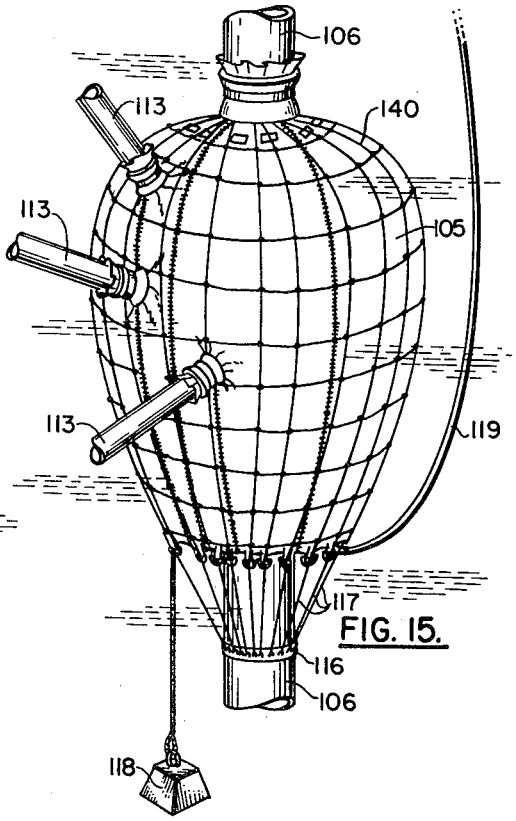

Alternately, an enclosing net 140 of mesh material, following the general configuration of the air bag but defining substantially less enclosed volume when fully extended than the air bag, is placed on the exterior of the air bag before inflation (note FIG. 14). When the bag is inflated, the outer net 140, having a less total maximum confined volume, prevents the bag from being expanded to its full extent (note FIG. 15). The net 140 thus prevents the creation of any substantial or damaging lateral or surface on the zipper structure and absorbs the bulk of the stresses.

Of course, it may be desirable to provide a different gaseous enviroment other than air, for example, in welding, certain inert gases surrounding the work area may be desirable. Indeed, it may in some cases be desirable to provide a liquid enviroment other than water for the work area and, as long as that liquid is substantially less dense than the surrounding water, such as liquid enviroment could be used.

The inflatable structure of the present invention is designed to have a great degree of flexibility and adaptability. In use various different needs may exist or unique problems arise, most if not all of which can be readily met and faced.

Figure 16:
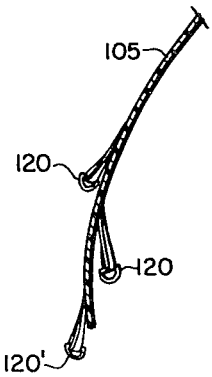
Figure 17:
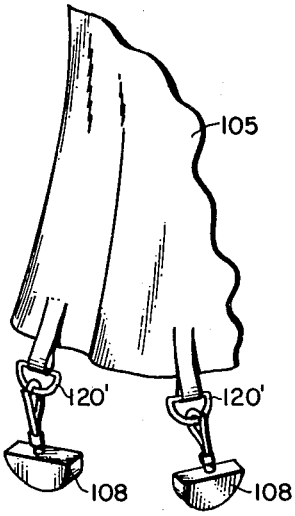

In particular, as generally illustrated in FIG. 16, various "D" ring elements 120 are placed about the air bag material 105 on both sides of the material. These elements 120 can be used on the exterior to tie or weight down the material 105 or internally can be used to support underwater lights or other accessories. As discussed above, the bottom "D" ring elements 120 can be used to add on snap-on weights 108 during the initial assembly steps of the air wrap structure.

Figure 18A:
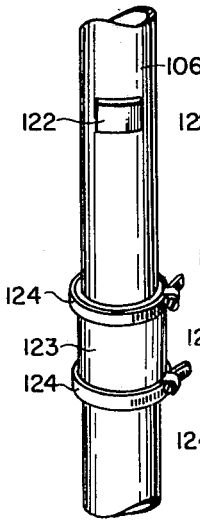
Figure 18B:
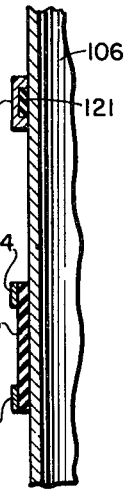

In some situations, the structural support members 106 or structural cross-members 113 themselves may be fractured around the work area, resulting in an undesirable air leak from the inflated air wrap structure. In such cases, secondary sealing means can be used to seal off these leaks. As shown in FIGS. 18A and B, small fractures in the steel column or casing 106 can be sealed by means of appropriate foam sealing material 121 held against the fracture by means of magnetic flange element 122. For large or long fractures, a large or extended piece of foam sealing material 123 held to and around the casing by means of two steel band clamps could be used.

Figure 19A:
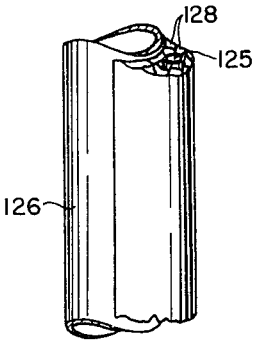
FIGS. 19A and B are side, perspective and top, cross-sectional views, respectively, of a structural support member with a riser tube next to it, illustrating the use of "hot dog" tubes to make a rounded structure.
Figure 19B:
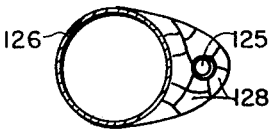
Figure 20:
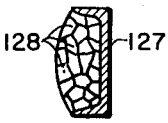

In some cases the structural support or cross-members in the work area do not present a completely rounded surface to which the neck portions of the air wrap material can be attached. Examples of such situations are when a riser tube 125 is juxtaposed next to a support member 126 (FIGS. 19A and B) or when the structural member is not a pipe or cylindrical casing but rather an "I" beam or channel beam 127 (FIG. 20). In order to create a rounded surface in such situations, relatively small, inflatable, "hot dog" shaped filter bags 128 inflated to a high pressure are used. The "hot dog" bags 128 are placed in and around the undersirable surface contours until a generally rounded surface is presented. Because of the pressure differential between that of the "hot dog" bags and the neck portions 111, 112 of the air wrap material when fastened about the structural members 125 – 126, 127 with the bags 128 added, the "hot dog" bags under the pressure of the neck portion will present a smoothly rounded surface making for a good interfacing seal between the two. As illustrated in FIGS. 19B and 20, when presenting this smoothly rounded surface, the cross-sections of the bags 128 will lose their own rounded shape and conform to the surfaces which they meet.

Figure 21:
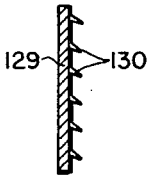

As shown in FIG. 21, the stress clamps 129 used against a metal surface may have on their inner surface, i. e. the surface bearing against the material being clamped, a series of "teeth" 130 to give a better grip to the clamp.

Figure 22:
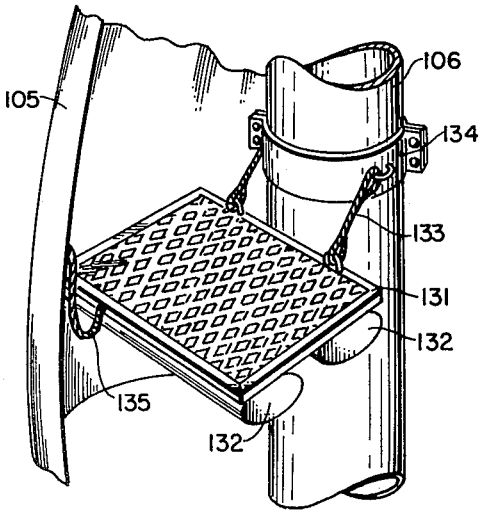

To enhance the use of the work area created within the inflated structure of the present invention various other accessories may be used. As illustrated in FIG. 22 a floating working platform 131 can be provided. The platform 131 floats on two pontoons 132 and is tied to the column 106 by means of support cables 133 and stress clamp 134. The platform could be further secured to the air wrap structure 105 by means of line 135 attached to an internal "D" ring element.

Figure 23:
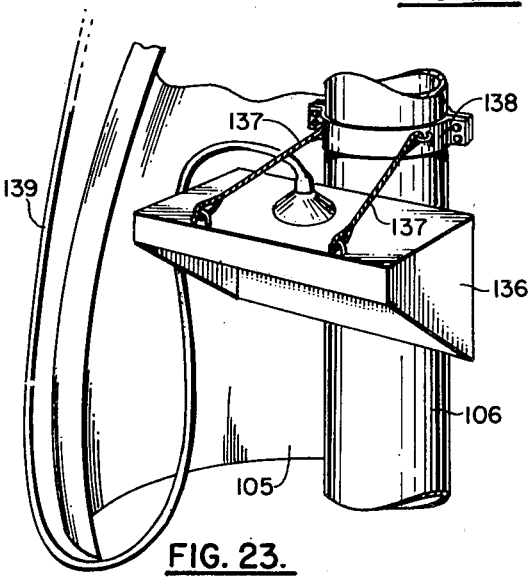

Likewise, a welding hood 136 could be attached to the column 106 by means of support cables 137 connected to stress clamp 138 (note FIG. 23). An appropriate exhaust line 139 would lead from the top of the hood 136 down and outside of the air wrap structure 105 up to the surface.

METHOD OF INSTALLATION

A method of installing the multi-sectioned inflatable structure of the present invention is as follows:

By the use of divers the area to be worked upon is surveyed and the dimensions and structural disposition and alignment of the work area are detailed. In accordance with the results of the survey, the appropriate sections to make up the inflated structure are selected and prepared.

As a precaution and to permit pre-assembly, it is desirable to make a mock-up of the work area on the surface and the sections pre-assembled on the mock-up or dummy rack to insure a good fit. After complete assembly on the mock-up one whole seam from top to bottom is unzippered and all neck interfaces and seams leading thereto are opened. The partially opened but interconnected sections of the material are then folded into a bundle 101 and tied to an anchor strap 102 which in turn is tied to a lowering cable 103 having a weight 104 at its end.

Figure 11:
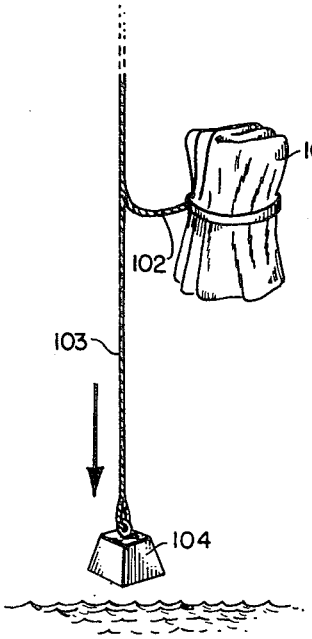
FIGS. 11 – 15 are perspective views of the the various steps followed in assembling and inflating the inflated structure of the present invention.
Figure 12:
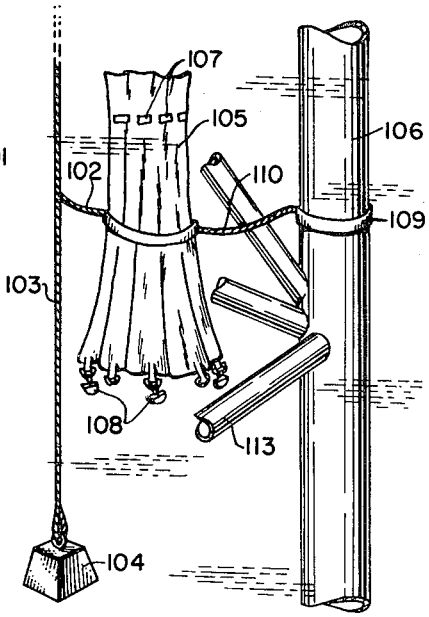

As illustrated in FIG. 11, the weighted cable 103 is then lowered into the water for preliminary connecting of the air bag material 105 to the support structure 106 in the area where the work is to be performed. As the air bag material 101/105 is lowered, the air bag material 105 expands (note FIG. 12) due to the flotation pockets 107 of styrofoam keeping the upper half up. The anchor strap 102 is tied to the air bag material 101/105 at approximately the middle of the material and supplemental, lowering weights 108 are attached to the bottom of the material 101/105. As a result, the air bag material 105 opens out with a vertical disposition comparable to its general disposition when installed.

After or as the air bag material 101/105 is lowered to the desired position along side the work area, a diver descends to install the material. The diver attaches a temporary band 109, which can be a small stress band, to the vertical support column 106 and also to the middle of the air bag material 105 by means of line 110 (note FIG. 12).

Figure 13:
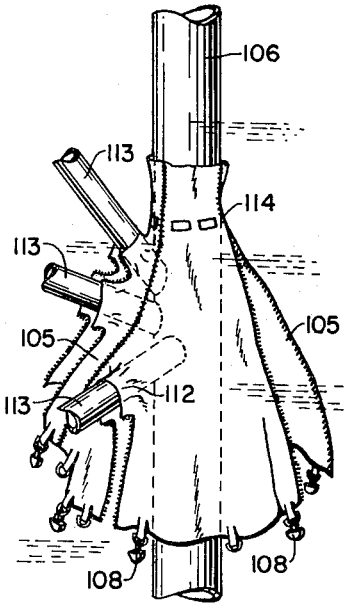

As illustrated in FIG. 13, the air wrap material is then placed about the steel column 106 so that the intermediate neck portions 112 are aligned with their corresponding cross-members 113, and its upper end attached to the column by means of its neck interface portion 111 (note FIG. 14). The full seam 114 that was completely opened on the surface after the pre-assembly is then at least partially zippered closed.

The neck interface portions 112 are then secured about the cross-members 113 and clamped tight. The zippers 114 and 115 are then zippered completely closed.

A lower stress clamp 116 is then placed down below the air wrap material 105 on the support column 106 at the desired, pre-selected level. Tie down lines 117 are attached between the bottom of the material 105 and the lower stress clamp ease in order to hold down the air wrap structure 105 when inflated. Alternatively or additionally, weights 118 can be tied to the bottom of the air bag material 105 to hold it down.

A mesh net 140 of suitable material such as nylon rope or the like is placed over the zippered sections of the air bag and likewise attached to the lower stress clamp 116. The net 140 can be provided in sections for ease in application and the sections tied together after application. As indicated supra, the net 140 when fully expanded must define or enclose a volume substantially less than the air bag would if fully expanded.

The on-site assembly of the basic inflatable structure is now complete and air or other appropriate gas is introduced by means of air hose 119 and the structure is inflated. Upon inflation, an artificial air enviroment is provided so that a worker can perform his work in air rather than in a wet enviroment regardless of sub-sea depth.

The inflatable air bag of the present invention, as well as being flexible in structural details, is also flexible in application. The air bag concept of the present invention, although particularly applicable to sub-sea work may also be applied to situations on land where a special enviroment or simple enclosure is needed.

Moreover, total submersion of the bag is not necessary for its operation in the marine field. Indeed, one particular useful application of the present invention is to the repair and maintenance work of off-shore installations at the water/air interface of the structure. Wave action on these structures causes a particularly severe corrossion problem. In such repair or maintenance work the air bag would be only partially below water, its lower extremity being submerged providing a seal while its upper extremity would be above water.

Although a particular structural application, i.e. a structure having a vertical column with several diverging arms, is illustrated herein for a description of the preferred embodiments, the invention is of course not so limited. The air bag can be easily adapted to practically any structure, whether horizontal, vertical, angular or a combination thereof. For example, the air bag can be used to repair or work on off-shore or sub-sea pipelines which lie on the ocean floor, basically a horizontal application, by arranging the neck opening at opposite sides and tying the bag down and under the pipeline.

As is readily apparent from the discussion above and the various exemplary alternatives, nearly unlimited variations, alterations and changes in the design and detail of the preferred embodiments and their applications are possible within the scope of this invention.

Because the invention is capable of many different embodiments and of being practiced and carried out in various ways, it should be understood that the invention is not limited in its application to the details and arrangement of parts illustrated in the accompanying drawings. It should also be understood that the phraseology or terminology employed herein is merely for the purpose of description and not of limitation, and the invention claimed herein is not to be limited beyond the requirements of the prior art.

What is claimed for invention is:

1. The method of providing an enclosure, at least a part of which is in water, comprising the following steps:

a. providing an enclosure structure comprising a multiple number of separate but joinable, extended, flexible sheet sections of flexible, pliable, sheet material, and joining means mounted at the edges of said sections for joining them together, said sections when joined together having at least one aperture therein and a relatively large bottom opening;

b. providing an outer enclosing net of mesh material following the general configuration of said sheet sections when joined together but defining substantially less enclosed volume than said sheet sections when joined together and when fully extended;

c. submerging at least a substantial portion of said enclosure structure into the water;

d. placing and forming the enclosure structure about the rigid structure in its flexible condition and joining said sections together so that the rigid structure goes through said aperture;

e. fitting said aperture around the rigid structure;

f. securing the bottom opening under the water surface to the rigid structure at a position lower than said aperture forming an inverted bag-like structure from said enclosure structure, at least a part of which is under water;

g. placing said net on the exterior of said sheet sections; and h. inflating the inner volume defined by said enclosure structure with a gaseous medium which supports it by its expansive pressure, said net preventing the creation of any substantial, damaging lateral or surface stresses on said joining means during inflation; whereby an inflated enclosed underwater workspace having an internal gaseous environment therein is provided in the water about the rigid structure, said internal environment being different from that on the outside of said enclosure structure.

2. The method of providing an enclosure, at least a part of which is to be in water, about a rigid structure at least a part of which is in water, comprising the following steps:

a. providing an enclosure structure comprising a multiple number of separate but joinable, extended, flexible sheet sections of flexible, pliable, sheet material, and joining means mounted at the edges of said sections for joining them together, said sections when joined together having at least one aperture therein and a relatively large bottom opening, and a series of tie down lines connected to said sheet sections around said bottom opening;

b. submerging at least a substantial portion of said enclosure structure into the water;

c. placing and forming the enclosure structure about the rigid structure in its flexible condition and joining said sections together so that the rigid structure goes through said aperture;

d. fitting said aperture around the rigid structure;

e. securing the bottom opening under the water surface to the rigid structure at a position lower than said aperture forming an inverted bag-like structure from said enclosure structure, at least a part of which is under water, by tying down said lines to said rigid structure; and f. inflating the inner volume defined by said enclosure structure with a gaseous medium which supports it by its expansive pressure; whereby an inflated enclosed underwater workspace having an internal gaseous environment therein is provided in the water about the rigid structure, said internal environment being different from that on the outside of said enclosure structure.

3. The method of claim 2 wherein said joining means include zipper structures and wherein said joining of step "c" is accomplished by zipping said sheet sections together.

4. The method of claim 2 wherein in step "a" said joining means include a series of stress belt means for positioning across the joining means, and wherein said joining of step "c" includes the positioning and fastening of said stress belt means together to pull said sheet sections together to take up the lateral stress in those areas.

5. The method of claim 2 wherein there is further included sealing means for sealing said aperture about said rigid structure, and wherein between step "d" and step "f" there is fully included the steps of:

i. positioning said sealing means about said aperture and said rigid structure; and ii. at least substantially sealing said aperture about said rigid structure with said sealing means.

6. The method of claim 5 wherein said sealing means includes a layer of foam material and clamping means, and wherein there is included in step "i" the step of placing said foam material in juxtaposition to the sheet material which forms said aperture, and in step "ii" clamping said sheet section and said layer of foam material tightly to the rigid structure with the use of said clamping means.

7. The method of claim 2 wherein there is further included the preliminary steps of:

i. sending divers down to survey the rigid structure about which the enclosure structure is to be provided, detailing the dimensions and structural disposition and alignment of the rigid structure; and ii. selecting and preparing the appropriate flexible sheet sections to make up an appropriate enclosure structure for the rigid structure surveyed.

8. The method of claim 7 wherein there is further included the step of:

iii. making a mock-up of the surveyed rigid structure on the surface; and iv. pre-assembling the selected flexible sections on the mock-up to insure a good fit.

9. The method of providing an enclosure, at least a part of which is to be in water, about rigid structure at least a part of which is in water and at least a part of which is irregular forming irregular surface contours, comprising the following steps:

a. providing an enclosure structure comprising a multiple number of separate but joinable, extended, flexible sheet sections of flexible, pliable, sheet material, and joining means mounted at the edges of said sections for joining them together, said sections when joined together having at least one aperture therein and a relatively large bottom opening;

b. providing a multiple number of relatively small, inflatable filler bags inflated to a high pressure;

c. submerging at least a substantial portion of said enclosure structure into the water;

d. placing and forming the enclosure structure about the rigid structure in its flexible condition and joining said sections together so that the rigid structure goes through said aperture;

e. placing said filler bags in and around the irregular surface contours to produce a generally rounded surface;

f. fitting said aperture around the rigid structure;

g. securing the bottom opening under the water surface to the rigid structure at a position lower than said aperture forming an inverted bag-like structure from said enclosure structure, at least a part of which is under water; and h. inflating the inner volume defined by said enclosure structure with a gaseous medium which supports it by its expansive pressure; whereby an inflated enclosed underwater workspace having an internal gaseous environment therein is provided in the water about the rigid structure, said internal environment being different from that on the outside of said enclosure structure.

10. The method of providing an enclosure, at least a part of which is to be in water, about a rigid structure at least a part of which is in water, comprising the following steps:

a. providing an enclosure structure comprising a multiple number of separate but joinable, extended, flexible sheet sections of flexible, pliable, sheet material, and joining means mounted at the edges of said sections for joining them together, said sections when joined together having at least one aperture therein and a relatively large bottom opening;

b. providing said flexible sheet sections with flotation elements at their upper end portions and weights at their lower end portions; whereby, as the weighted bundles are lowered into water, said sheet sections expand due to said flotation elements keeping the upper portions up;

c. bundling up said flexible sheet sections about their mid-sections;

d. lowering the weighted bundles into the water in order to place said enclosure structure about said rigid structure;

e. submerging at least a substantial portion of said enclosure structure into the water;

f. unbundling said sheet sections while in their vertical position at a depth comparable to their general dispositions in forming said enclosure structure;

g. placing and forming the enclosure structure about the rigid structure in its flexible condition and joining said sections together so that the rigid structure goes through said aperture;

h. fitting said aperture around the rigid structure;

i. securing the bottom opening under the water surface to the rigid structure at a position lower than said aperture forming an inverted bag-like structure from said enclosure structure, at least a part of which is under water; and j. inflating the inner volume defined by said enclosure structure with a gaseous medium which supports it by its expansive pressure; whereby an inflated enclosed underwater workspace having an internal gaseous environment therein is provided in the water about the rigid structure, said internal environment being different from that on the outside of said enclosure structure.

* * * * *